US012622492B2

(12) United States Patent
Sofia

(10) Patent No.: US 12,622,492 B2
(45) Date of Patent: May 12, 2026

(54) SLIP-RESISTANT BUCKLE FOR SAFETY SWIMMING POOL COVER STRAPS

(71) Applicant: Pool Cover Corporation, Hauppauge, NY (US)

(72) Inventor: Michael Sofia, Holbrook, NY (US)

(73) Assignee: Pool Cover Corporation, Hauppauge, NY (US)

( * ) Notice: Subject to any disclaimer, the term of this patent is extended or adjusted under 35 U.S.C. 154(b) by 149 days.

(21) Appl. No.: 18/755,229

(22) Filed: Jun. 26, 2024

(65) Prior Publication Data

US 2026/0000158 A1 Jan. 1, 2026

(51) Int. Cl.

| | |
|---|---|
| ***A44B 11/10*** | (2006.01) |
| ***A44B 11/25*** | (2006.01) |
| ***E04H 4/10*** | (2006.01) |

(52) U.S. Cl.

CPC ..... *A44B 11/10* (2013.01); *A44B 11/2592* (2013.01); *E04H 4/10* (2013.01)

(58) Field of Classification Search

CPC ..... A44B 11/10; A44B 11/2592; E04H 4/10; E04H 4/06

See application file for complete search history.

(56) References Cited

U.S. PATENT DOCUMENTS

| | | | |
|---|---|---|---|
| 198,097 | A | 12/1877 | Fries |
| 441,249 | A | 11/1890 | Magraw |
| 499,225 | A | 6/1893 | George |
| 770,702 | A | 9/1904 | Schlichter |
| 1,037,045 | A | 8/1912 | Patton |
| 1,042,753 | A | 10/1912 | Delbert |

(Continued)

FOREIGN PATENT DOCUMENTS

| | | | |
|---|---|---|---|
| DE | 1976085 | U | 12/1967 |
| FR | 2653811 | B1 | 1/1992 |
| FR | 3034122 | B1 | 3/2017 |

OTHER PUBLICATIONS

Richmond Civil War Antiques, LLC—Two Piece Buckle. Catalog. Apr. 15, 2024. 2 pages. https://rcwantiques.com/product/two-piece-militia-buckle/.

(Continued)

*Primary Examiner* — David M Upchurch

(74) *Attorney, Agent, or Firm* — Michael J Porco; Gerald E Hespos

(57) ABSTRACT

A 2-piece buckle connects buckle straps within a safety swimming pool cover. The 2-piece buckle is used in place of a strap/buckle system. The interlocking design allows for a quick, secure attachment that remains unaffected over time by weathering. The tension within the pool cover, along with the interlocking design, secures the 2-component attachment. The "half-moon" prong of the buckle is inserted through the open triangle shape of the other buckle half through the bottom, at an approximate 90-degree angle. The prong is then turned 90 degrees, rotated upward, and the two halves are "locked" into place. After the buckles are connected, the cover can be installed and tensioned over the pool. Tensioning prevents the 2 halves of the buckle from being rotated and disengaged. Disengagement can be performed once the pool cover anchoring hardware has been disengaged and the tension in the cover has been relieved.

5 Claims, 9 Drawing Sheets

(56) References Cited

U.S. PATENT DOCUMENTS

| | | | | |
|---|---|---|---|---|
| 1,494,610 | A | 5/1924 | James | |
| 2,477,575 | A | 8/1949 | Bubser | |
| 2,809,408 | A | 10/1957 | Goldstein | |
| 2,958,872 | A * | 11/1960 | Meyer, Jr. | E04H 4/10 5/199 |
| 3,222,739 | A | 12/1965 | Davis | |
| 3,391,410 | A | 7/1968 | Melberg | |
| 4,094,021 | A | 6/1978 | Rapp | |
| 4,197,595 | A | 4/1980 | Dearing | |
| 4,399,594 | A | 8/1983 | Ostermaier | |
| 4,413,389 | A | 11/1983 | Lowe | |
| 4,524,495 | A | 6/1985 | Hess | |
| 4,713,864 | A | 12/1987 | Hess | |
| D364,126 | S | 11/1995 | Ishida et al. | |
| D371,525 | S | 7/1996 | Bao et al. | |
| 5,608,926 | A | 3/1997 | Donaton | |
| 5,740,562 | A | 4/1998 | Nickalo | |
| 5,915,630 | A | 6/1999 | Step | |
| 6,539,593 | B2 | 4/2003 | Morris | |
| 6,606,752 | B2 | 8/2003 | Marbach | |
| 6,755,383 | B2 | 6/2004 | Davis | |
| 6,804,868 | B2 | 10/2004 | Fox | |
| 7,073,234 | B2 * | 7/2006 | Turpin | A44B 11/263 24/616 |
| 7,389,551 | B2 * | 6/2008 | Stebner | E04H 4/08 70/164 |
| D590,705 | S | 4/2009 | Kuhlmann | |
| 7,712,160 | B2 | 5/2010 | Pesta | |
| 7,735,163 | B2 | 6/2010 | Pesta et al. | |
| 7,793,390 | B2 | 9/2010 | Mills et al. | |
| D625,654 | S | 10/2010 | Spater | |
| 8,151,381 | B2 | 4/2012 | Pesta | |
| D687,347 | S | 8/2013 | Gillan | |
| 8,752,221 | B2 * | 6/2014 | Ortega | A47C 20/026 5/652 |
| 8,819,960 | B2 | 9/2014 | Nishida | |
| 9,709,082 | B2 | 7/2017 | Lin et al. | |
| 10,028,553 | B1 | 7/2018 | Hinkle | |
| 10,443,263 | B2 | 10/2019 | Lahood | |
| 11,064,770 | B2 | 7/2021 | Ressler | |
| 11,109,646 | B2 | 9/2021 | Hortnagl | |
| 11,191,325 | B2 | 12/2021 | Hetrich | |
| 11,266,192 | B2 * | 3/2022 | Pagano | A44B 11/263 |
| 11,839,270 | B1 | 12/2023 | Besbelli | |
| 2003/0177570 | A1 * | 9/2003 | St-Hilaire | E04H 4/10 4/498 |
| 2005/0108818 | A1 * | 5/2005 | Cordray | E04H 4/10 4/503 |
| 2012/0017550 | A1 | 1/2012 | Cammas | |
| 2020/0008537 | A1 | 1/2020 | Sepe | |

OTHER PUBLICATIONS

Ebay—Crescent Buckle Connector. Website. Apr. 15, 2024. 6 pages. https://www.ebay.com/itm/386816992404?

E-Buttons—Hook and Eye Buckle. Website. Apr. 15, 2024. 1 page. https://www.e-buttons.com/hook-and-eye-buckle-7,5-mm-frog-fasteners-e-1762.

Ebay- Benecreat Pool Cover Buckle. Website. Apr. 15, 2024. 3 pages. https://www.ebay.com/itm/276033167715.

"Hardware"—meycocovers.com. Website. Jan. 26, 2024. 7 pages. https://meycocovers.com/pool-covers/accessories/.

Spring to Ratchet Safety Pool Cover Conversion Kits—lookoutmountaintarp.com. Website. May 29, 2023. 2 pages. https://web.archive.org/web/20230529030841/https://lookoutmountaintarp.com/i-30497741-spring-to-ratchet-safety-pool-cover-conversion-kits.html.

ACSSTRAP Security Strap, Spa Cover, 12 ft Long , 2 inch strap & stainless steel hardware—directhottubparts.com. Website. Jan. 26, 2024. 5 pages. https://web.archive.org/web/20240126064053/https://www.directhottubparts.com/security-strap-spa-cover-12-ft-long-2-inch-strap-acsstrap.

* cited by examiner

SLIP-RESISTANT BUCKLE FOR SAFETY SWIMMING POOL COVER STRAPS

FIELD OF THE INVENTION

The present invention relates to a slip-resistant buckle for safety swimming pool cover straps.

BACKGROUND OF THE INVENTION

In certain circumstances, there are times when a safety swimming pool cover must be designed and manufactured with obstacle avoidance accommodations (slot cutouts). For example, a swimming pool may include a handrail for entry/exit, or a commercial pool may include a water feature within the interior of the pool. These conditions require accommodations for the design/installation of the swimming pool cover.

Currently, Loop-Loc provides "slot cutouts" located at the exact location of the permanent rails and other obstructions. These slot cutouts allow the cover to pass around the obstruction and maintain total coverage denying access to the water below. Securement of the slot cutout is achieved with webbing straps which pass through a stainless-steel buckle.

In addition to rail cutouts, the current strap/buckle securement system is currently used for ladder, water feature, and spa-access slot cutouts. These cutouts can range in length, and it is not uncommon for them to reach lengths in excess of 20 feet.

There are 2 disadvantages to the current strap/buckle system. Firstly, Loop-Loc's design guidelines require that the strap/buckle be placed every 3". Installers report that the attachment for this system, especially on very long slot cutouts, is too laborious and requires excessive installation time.

Secondly, over a time period of years, the webbing straps become weathered, rigid, and difficult to work with. Weathered polypropylene webbing straps become stiff and difficult to weave through the stainless-steel buckle.

Therefore, the use of slip-resistant buckles, as in Applicant's present invention, in conjunction with buckle straps being provided over the obstacle avoidance gaps (slot cutouts) is not only not suggested but would be discouraged or taught away by the references relied on.

OBJECTS OF THE INVENTION

It is therefore an object of the present invention to provide a slip-resistant buckle for safety swimming pool cover straps.

It is also an object of the present invention to provide a buckle having a crescent-shaped half-moon protruding prong, which inserts into a triangular receptacle by insertion of a corner of the crescent-shaped half-moon protruding prong, and then rotating the crescent-shaped half-moon prong under the surface base of the triangular receptacle of the buckle for the safety swimming pool cover straps, which promotes slip resistance of the straps of the buckle of the safety swimming pool cover over obstacle avoidance gaps (slot cutouts) of the safety swimming pool cover.

Other objects which become apparent from the following description of the present invention.

SUMMARY OF THE INVENTION

In keeping with these objects and others which may become apparent, the present invention is a slip-resistant buckle for safety swimming pool cover straps. The buckle has a crescent-shaped half-moon protruding prong, which inserts into a triangular receptacle by insertion of a corner of the crescent-shaped half-moon protruding prong, and then the crescent-shaped half-moon prong is rotated under the surface base of the triangular receptacle of the buckle for the safety swimming pool cover straps, promoting slip resistance of the straps of the buckle of the safety swimming pool cover.

The buckle of the present invention enhances the slip-resistance of the buckle components and buckle straps by incorporating the crescent-shaped half-moon protruding prong, which remains fixed in place within the base of the triangular receptacle so that the straps of the safety swimming pool cover do not move like Prior Art straps, which are held in place by a looping of a buckle prong over a rectangular ring of the buckle, back against itself. Over time, the Prior Art buckle straps loosen and bend due to winter weather and stress of holding the pool cover in place. When the Prior Art buckles and straps bend under torque and pressure, they can cause the base bars of the loop buckle to bend and/or break, thereby causing the detrimental loosening of the pool cover straps over the Prior Art obstacle avoidance cutouts in the swimming pool cover and also compromising the tightness of the pool cover over the swimming pool during winter use.

In contrast, the addition of the new buckle with the crescent-shaped half-moon protruding prong, which remains fixed in place within the base of the triangular receptacle so that the straps of the safety swimming pool cover do not slip out of position like Prior Art straps, which greatly enhances the slip resistance of the straps of the safety swimming pool cover.

The important slip-resistant function of the improved buckle is maintained with aforementioned features. The synergistic locking combination of the crescent-shaped half-moon protruding prong, which remains fixed in place within the base of the triangular receptacle provides beneficial effects that are not possible with existing types of loop buckles.

In the present invention, a novel 2-piece buckle is constructed of Type 316 Stainless Steel for use as a connection device component within a safety swimming pool cover.

The 2-piece buckle is used in place of the strap/buckle system. The simple interlocking design allows for a quick, secure attachment that remains unaffected over time by weathering.

The tension within the pool cover, along with the interlocking steel component design, secures the 2-component attachment.

The "half-moon" shape of the left-half of the buckle is inserted through the open triangle shape of the right-half of the buckle through the bottom. This occurs at an approximate 90-degree angle. The left-half is then turned 90 degrees, rotated upward, and the two halves are "locked" into place.

After all of the 2-piece buckles are connected, the cover can be installed and tensioned over the pool. The tension places a pulling force within the 2-part buckle. This tension makes it impossible for the 2 halves of the buckle to be rotated and disengaged. Disengagement can be performed once the pool cover anchoring hardware has been disengaged and the tension in the cover has been relieved.

BRIEF DESCRIPTION OF THE DRAWINGS

The present invention can best be understood in connection with the accompanying drawings. It is noted that the invention is not limited to the precise embodiments shown in the following drawings, in which.

DETAILED DESCRIPTION OF THE INVENTION

The present invention has broad applications to many technical fields for a variety of articles. For illustrative purposes only, a preferred mode for carrying out the invention is described herein.

Figure 1:
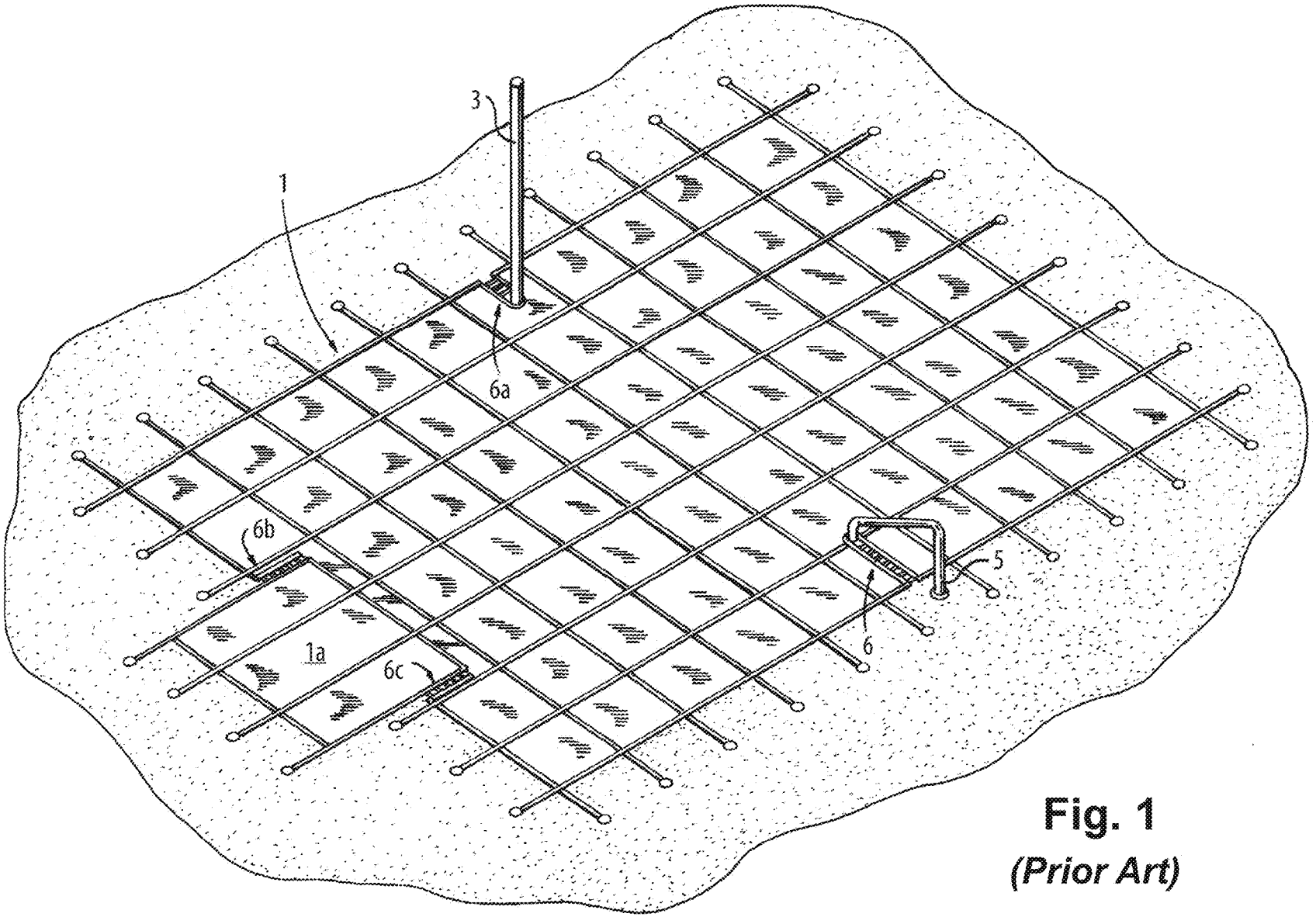
Fig. 1 (Prior Art)
FIG. 1 is a perspective view of a swimming pool with a safety pool cover, extending taut over a swimming pool during a winter season of non-use of the swimming pool, showing a railing and a pole obstructing the surface of the safety pool cover, whereby a cut-out portion of the swimming safety pool cover includes an open gap, having two edges, whereby the two edges are separated from each other over the open gap, but which edges need to be pulled taut by straps and buckles, so as not to compromise the taut plane of the swimming pool cover over the remainder of the swimming pool are connected by a multiple buckle straps by buckles, to tighten the pool cover straps over the open cutout gaps in the pool cover.
Figure 4:
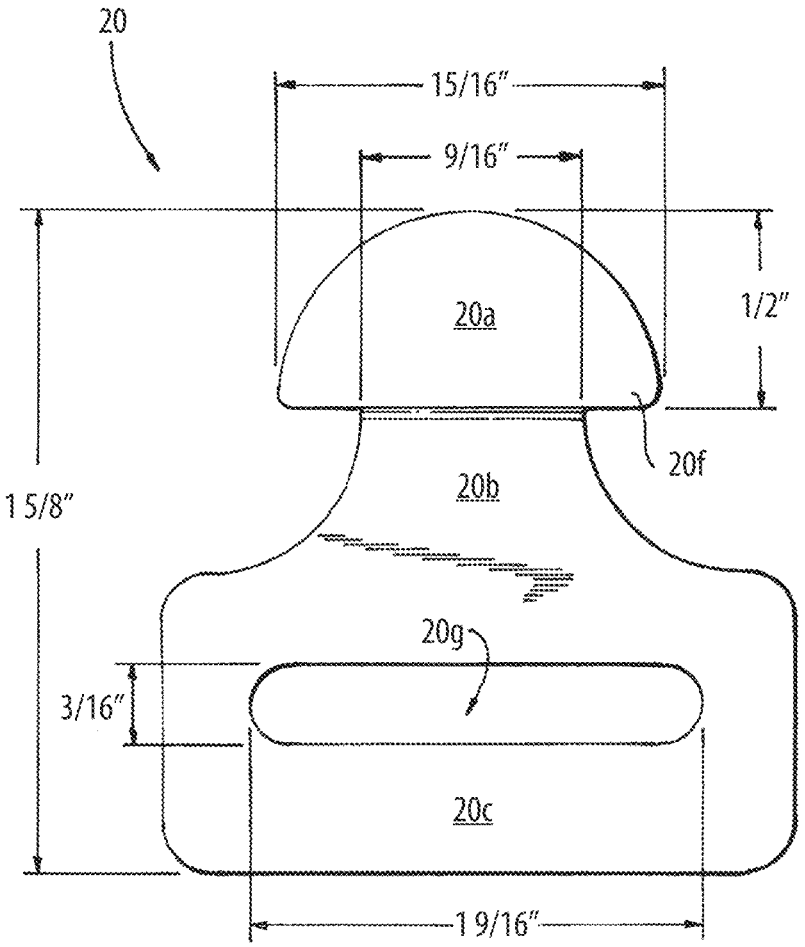
FIG. 4 is a front elevation view of a crescent-shaped half-moon protrusion insertion member/prong of a slip-resistant buckle for safety swimming pool cover straps of the present invention.
Figure 5:
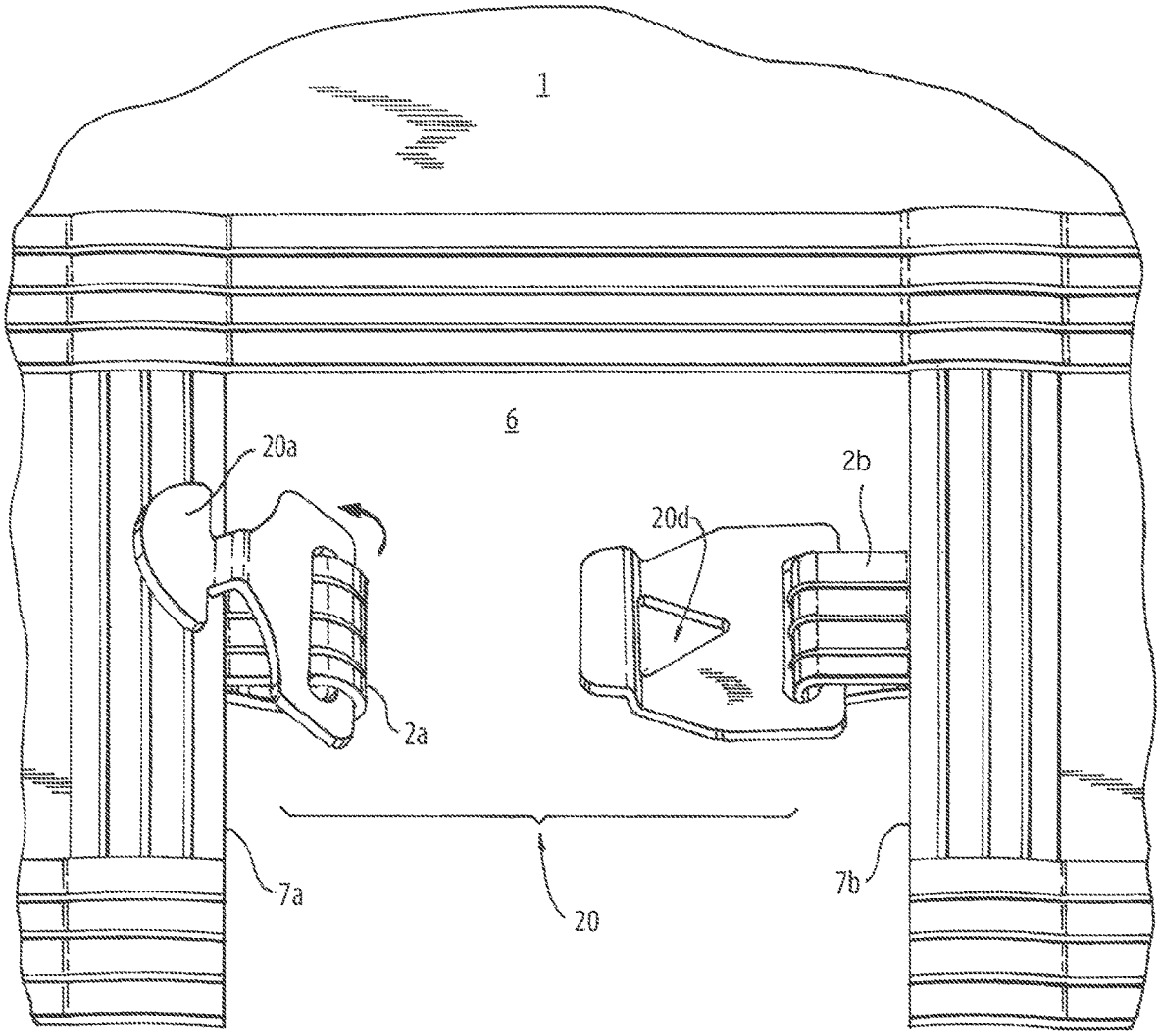
FIG. 5 is a close-up detailed view of the buckle of the present invention in a reverse rear-bottom position, with the crescent-shaped half-moon protrusion insertion member of a first pool cover strap, which is inserted edge-wise into a triangular receptacle member of a corresponding second pool cover strap, whereby the first and second pool cover straps are tightened in place to prevent the swimming pool cover from loosening in the area near the cutout gaps.
Figure 6:
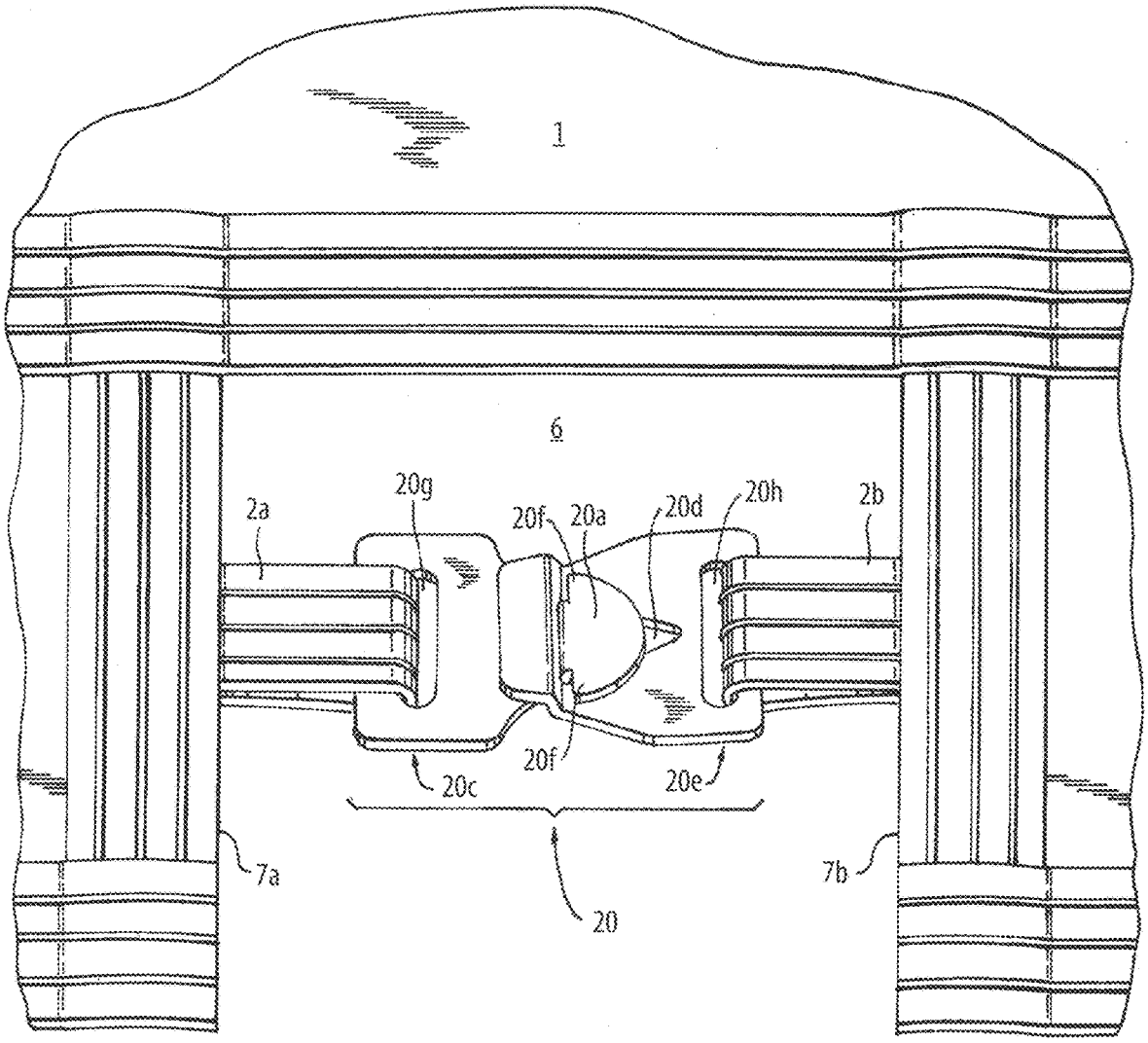
FIG. 6 is a close-up detailed view of the buckle of the present invention in a closed tightening position of use, with the crescent-shaped half-moon protrusion insertion member of a first pool cover strap, having been inserted edge-wise into a triangular receptacle member of a corresponding second pool cover strap, whereby the first and second pool cover straps have been tightened in place by the strap buckles to prevent the loosening of the swimming pool cover in the vicinity of the open cutout gap accommodating an obstacle, such as a hand railing or pole therein.

FIG. 1 is a perspective view of a swimming pool with a safety pool cover 1, showing a railing 5, a pole 3, and an auxiliary spa area pool cover 1*a* obstructing the surface of the safety pool cover 1, whereby a cut-out portion of the swimming safety pool cover 1 includes an open gap 6, 6*a*, 6*b*, 6*c*, each having two edges, whereby as shown in FIGS. 4, 5, and 6, the two edges are connected by longitudinally extending pool cover straps 2, 2 on each side portion 7*a* and 7*b* of the pool cover 1, with the buckle straps 2*a* and 2*b* having buckles 20 to tighten the pool cover buckle straps 2*a* and 2*b* over the open gaps 6, 6*a*, 6*b*, and 6*c*, so that the edges 7*a* and 7*b* of the gaps (slot cutouts) 6, 6*a*, 6*b*, and 6*c*, of the pool cover 1 are taut adjacent to the open cutout gap 6, 6*a*, 6*b* or 6*c* within the pool cover 1.

Figure 2:
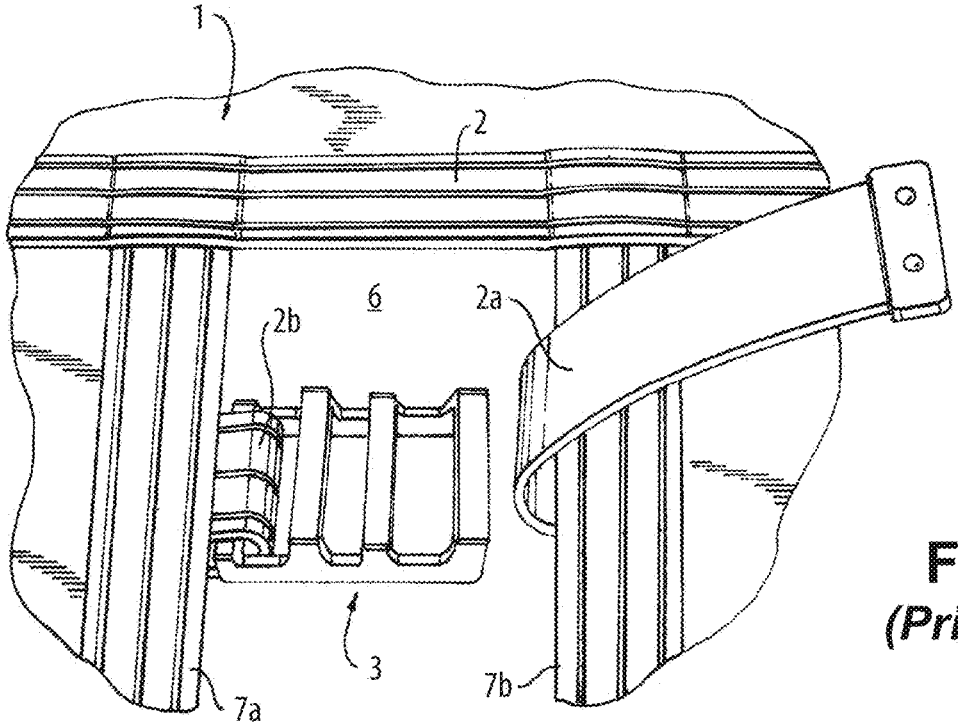
Fig. 2 (Prior Art)
FIG. 2 is a close-up detailed view of a prior art buckle closing the pool cover straps on each side portion of the open gap (slot cutout) in the swimming pool cover, whereby the prior art buckle is shown in an open position before a tightening use position.

FIG. 2 is a close-up detailed view of a prior art buckle 3 closing the pool cover buckle straps 2*a* and 2*b* on each side portion of the strip 7 covering the open gap 6, whereby the prior art buckle 3 is shown in an open position before a tightening use position.

Figure 3:
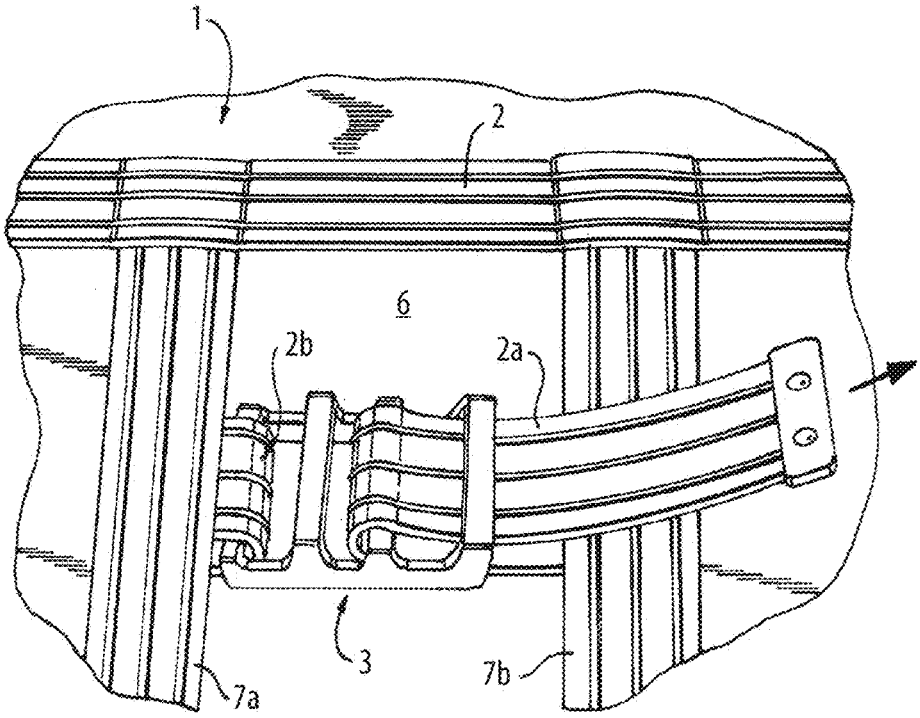
Fig. 3 (Prior Art)
FIG. 3 is a close-up detailed view of a prior art buckle closing the pool cover straps on each side portion of the open gap (slot cutout), whereby the prior art buckle is shown in a closed tightening use position.

FIG. 3 is a close-up detailed view of a prior art buckle 3 closing the pool cover straps 2*a* and 2*b* over the open gap 6, whereby the prior art buckle 3 is shown in a closed tightening use position.

In contrast to the Prior Art buckles 3, shown in FIGS. 2 and 3, FIG. 4 is a front elevation view of a crescent-shaped half-moon protrusion insertion member/prong 20*a* of a slip-resistant buckle 20 having a neck 20*b* connecting the crescent-shaped half-moon protrusion insertion member/prong 20*a* to a base 20*c* having an opening slot 20*g* accommodating a buckle strap 2*a* therethrough, for safety swimming pool cover straps of the present invention.

Figure 4A:
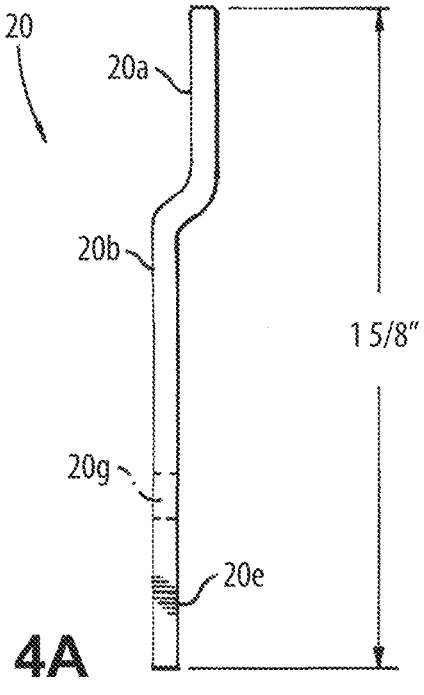
FIG. 4A is a side elevation view of the crescent-shaped half-moon protrusion insertion member/prong of the slip-resistant buckle, as in FIG. 4, for safety swimming pool cover straps of the present invention.
Figure 4B:
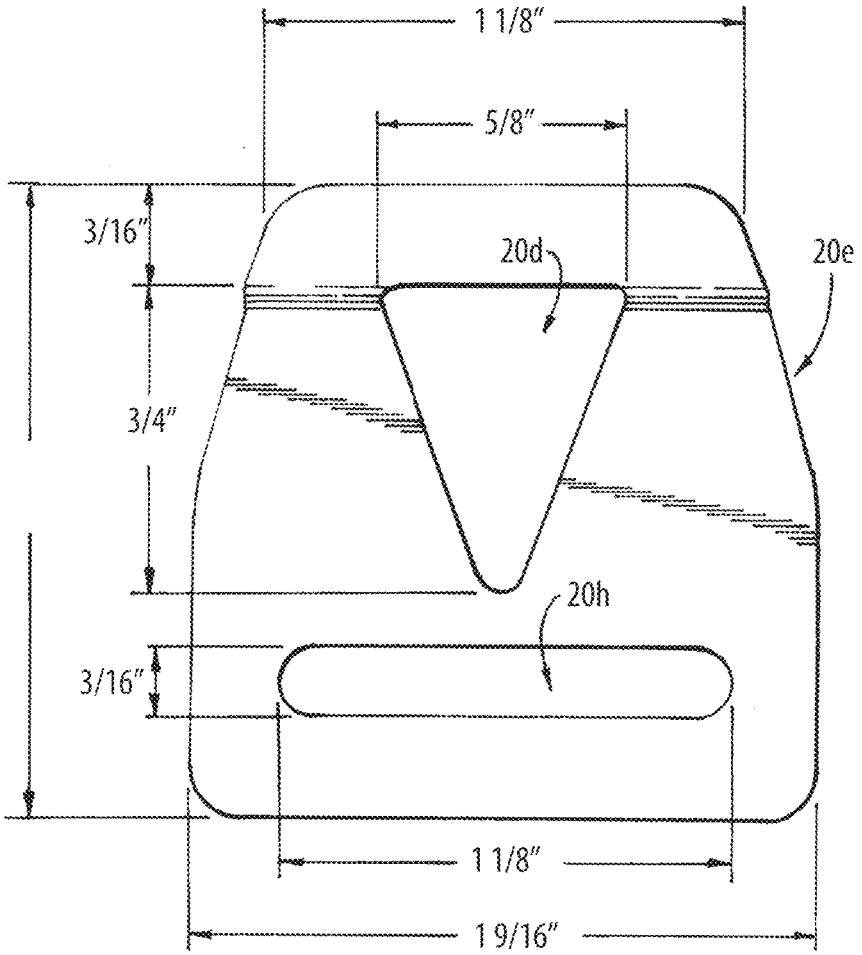
FIG. 4B a front elevation view of a buckle receptacle with a triangular opening for insertion therein of the crescent-shaped half-moon protrusion insertion member/prong of a slip-resistant buckle as in FIGS. 4 and 4A for safety swimming pool cover straps of the present invention.
Figure 4C:
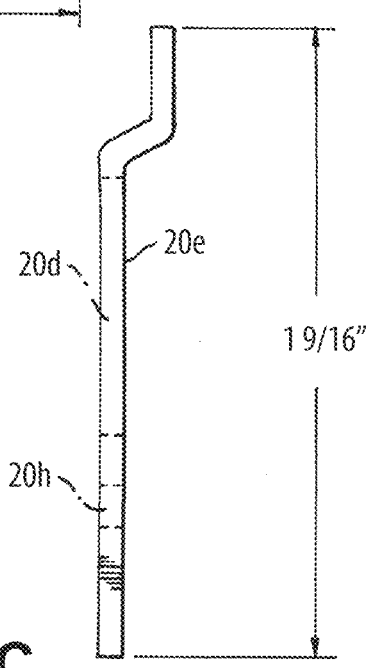
FIG. 4C is a side elevation view of the buckle receptacle with the triangular opening for insertion therein of the crescent-shaped half-moon protrusion insertion member/prong of a slip-resistant buckle as in FIGS. 4 and 4A.
Figure 4D:
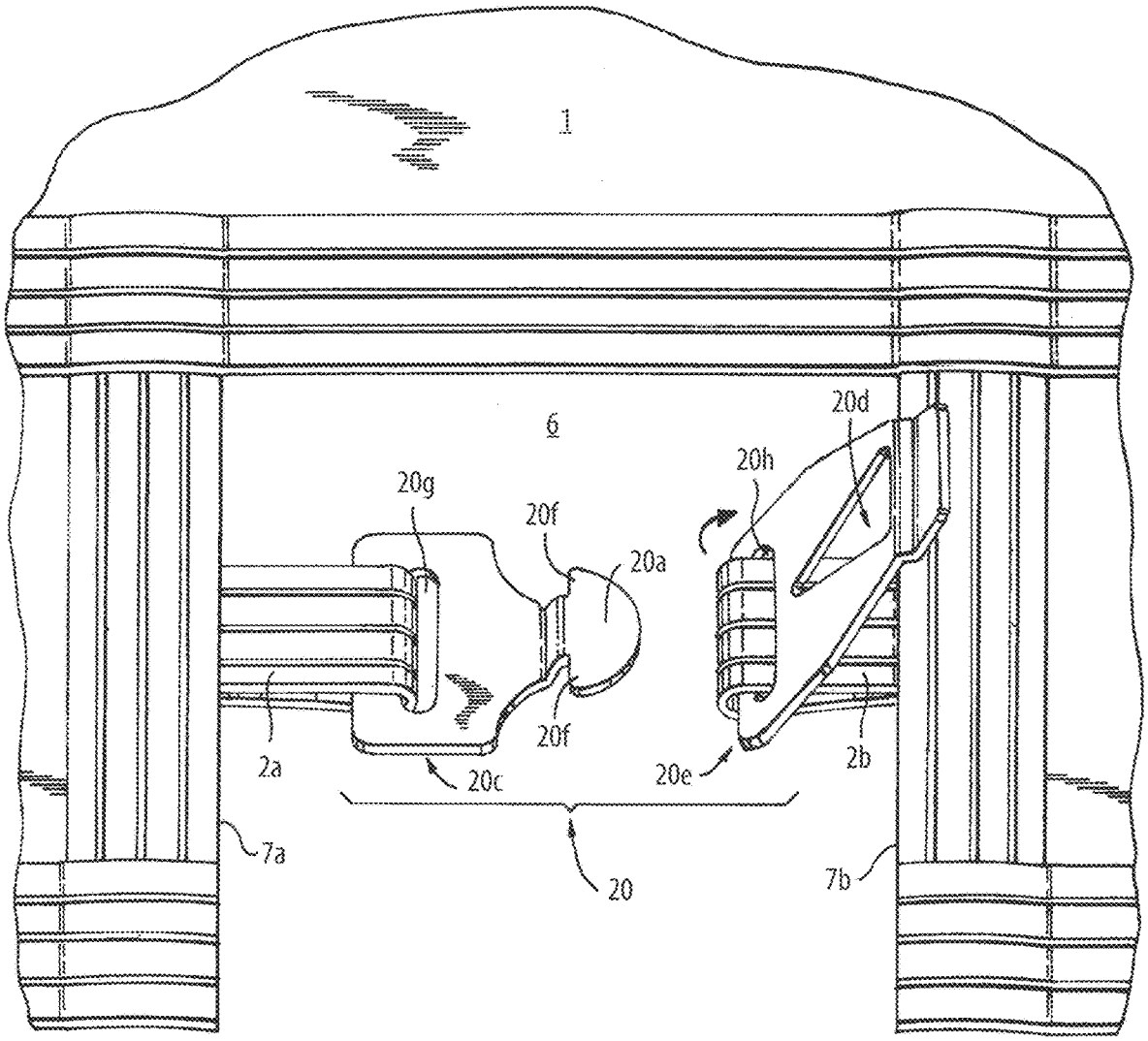
FIG. 4D is a close-up detailed view of the buckle of the present invention in an open front-top position, with the crescent-shaped half-moon protrusion insertion member of a first pool cover strap, which is inserted edge-wise into the triangular receptacle member of a corresponding second pool cover strap, whereby the first and second pool cover straps are tightened in place to prevent the swimming pool cover from loosening in the area near the cutout open gap.

Buckle 20 tightens edges 7*a* and 7*b* of the pool gap (slot cutout) 6, 6*a*, 6*b*, or 6*c*, by pulling buckle straps 2*a* and 2*b* taut, as shown in FIGS. 4D, 5 and 6.

FIG. 4A is a side elevation view of the crescent-shaped half-moon protrusion insertion member/prong 20*a* of the slip-resistant buckle 20, as in FIG. 4, for safety swimming pool cover straps of the present invention.

FIGS. 4 and 4A show the crescent-shaped half-moon protrusion insertion member/prong 20*a*. While dimensions may vary the base 20*c* thereof is approximately 1 9/16 inches in width and approximately 1 5/8 inches in height. The base 20*c* becomes a narrowed neck 20*b* which, at its narrowest top dimension is approximately 9/16 inches in width. Above the neck 20*b* is the crescent-shaped half-moon protrusion insertion member/prong 20*a* which has a width of approximately 15/16 inch and a height of approximately 1/2 inch at the apex of the crescent-shaped half-moon shape of prong 20*a*. A slot 20*g* in the base 20*c* has a width of approximately 1 1/8 inches and a height of approximately 3/16 inches (rounded at the edges) for insertion of the buckle strap 2*a* therein.

FIG. 4B a front elevation view of a buckle receptacle frame 20*e* with a triangular opening 20*d* for insertion therein of the corner 20*f* of the crescent-shaped half-moon protrusion insertion member/prong 20*a* of the slip-resistant buckle 20 as in FIGS. 4 and 4A for safety swimming pool cover straps of the present invention. Frame 20*e* also has a rectangular slot opening 20*h*, for insertion of opposing buckle straps 2*b* therein.

FIG. 4C is a side elevation view of the buckle receptacle frame 20*e* with the triangular receptacle opening 20*d* for insertion therein of a corner 20*f* of the crescent-shaped half-moon protrusion insertion member/prong 20*a* of a slip-resistant buckle 20 as in FIGS. 4 and 4A. FIGS. 4B and 4C show the receptacle with trapezoidal frame 20*e*. While dimensions may vary, the width of the receptacle frame 20*e* is approximately 1 9/16 inches in width and approximately 1 9/16 inches in height. A slot 20*h* for insertion of buckle strap 2*b* has a width of approximately 1 1/8 inches and a height of approximately 3/16 inches (rounded at the edges). Above the slot 20*h* there is provided a triangular opening 20*d* which is approximately 5/8 inches in width and approximately 3/4 inch in height. The top of the triangular opening 20*d* is approximately 5/8 of an inch but the equal sides of the triangular opening 20*d* are each approximately 13/16 inches in length. A corner 20*f* of the crescent-shaped half-moon protrusion insertion member/prong 20*a* is inserted within the triangular opening 20*d* and rotated so that the prong 20*a* has the apex of the crescent-shaped half-moon aligned in a line perpendicular to the axis of the slot 20*h* of the base 20*e* of the receptacle of the buckle 20.

FIG. 4D is a close-up detailed view of the buckle 20 of the present invention in an open front-top position, with a crescent-shaped half-moon protrusion insertion member/prong 20*a* connected by a neck 20*b* to a rounded corner rectangular base 20*c*. The rectangular base 20*c* includes a rectangular slot 20*g* for insertion of a first pool cover buckle strap 2*a* therethrough. The crescent-shaped half-moon protrusion insertion member/prong 20*a* is inserted edge-wise by the insertion corner 20*f* of the crescent-shaped half-moon prong 20*a* into a triangular receptacle hole 20*d* of the base receptacle frame 20*e*. Base receptacle frame 20*e* includes a further rectangular slot opening 20*h* for insertion therein of a corresponding second pool cover buckle strap 2*b*, whereby the first and second pool cover buckle straps 2*a* and 2*b* are tightened in place to prevent pool cover 1's edge portions 7*a* and 7*b*, which are adjacent to the open gaps 6, 6*a*, 6*b*, and 6*c* (shown in FIG. 1) from being loosened away from the safety pool cover 1 in the vicinity of the open cutout gaps 6, 6*a*, 6*b*, and 6*c* of the safety pool cover 1. Open cutout gaps 6, 6*a*, 6*b* and 6*c* are cutout from safety swimming pool cover 1, to accommodate obstacles within the swimming pool, such as entrance and exit hand railings 5, or poles 3, that extend upward above the plane of the flat safety swimming pool cover 1 over the swimming pool 10, indicated by the arrow 10 of FIGS. 1 and 9 herein.

FIG. 5 is a close-up detailed view of the buckle 20 of the present invention in a reverse rear-bottom position, with the crescent-shaped half-moon protrusion insertion member/prong 20*a* of a first pool cover buckle strap 2*a*, which is inserted edge-wise into a triangular receptacle member 20*d* of a corresponding second pool cover buckle strap 2*b*, whereby the first and second pool cover buckle straps 2*a* and 2*b* are tightened in place to prevent the pool cover 1's edge portions 7*a* and 7*b*, extending adjacent on with edge side of open gaps 6, 6*a*, 6*b*, or 6*c* (shown in FIG. 1) from being loosened away from the taut swimming pool cover 1, in the vicinity of the open gaps 6, 6*a*, 6*b*, or 6*c* permitting upwardly extending pool obstacles, such as hand railing 5 or pole 3, to extend above the taut plane of the swimming pool cover 1.

FIG. 6 is a close-up detailed view of the buckle 20 of the present invention in a closed tightening position of use, with the crescent-shaped half-moon protrusion insertion member/prong 20*a* of base 20*c* having slotted rectangular opening 20*g* to accommodate first pool cover buckle strap 2*a* therethrough to tighten edge 7*a* of swimming pool cover 1 to edge 7*b* of swimming pool cover 1 on an opposite side of cutout gap 6, 6*a*, 6*b* or 6*c* in swimming pool cover 1. To tighten buckle 20, connecting buckle strap 2*a* to buckle strap 2*b*, base frame 20*e* with triangular opening 20*d*, includes crescent shaped half-moon protrusion insertion member prong 20*a* having been inserted edge-wise into the triangular receptacle opening 20*d*, which itself also includes rectangular slot 20*h* accommodating corresponding second pool cover buckle strap 2*b* therethrough, whereby the first and second pool cover buckle straps 2*a* and 2*b* have been tightened in place to the pool cover edges 7*a* and 7*b* extending alongside the open gaps 6, 6*a*, 6*b*, or 6*c* (shown in FIG. 1) from being exposed away from the pool cover 1, adjacent to the cutout open gaps 6, 6*a*, 6*b*, or 6*c* cut out of pool cover 1.

Figure 7:
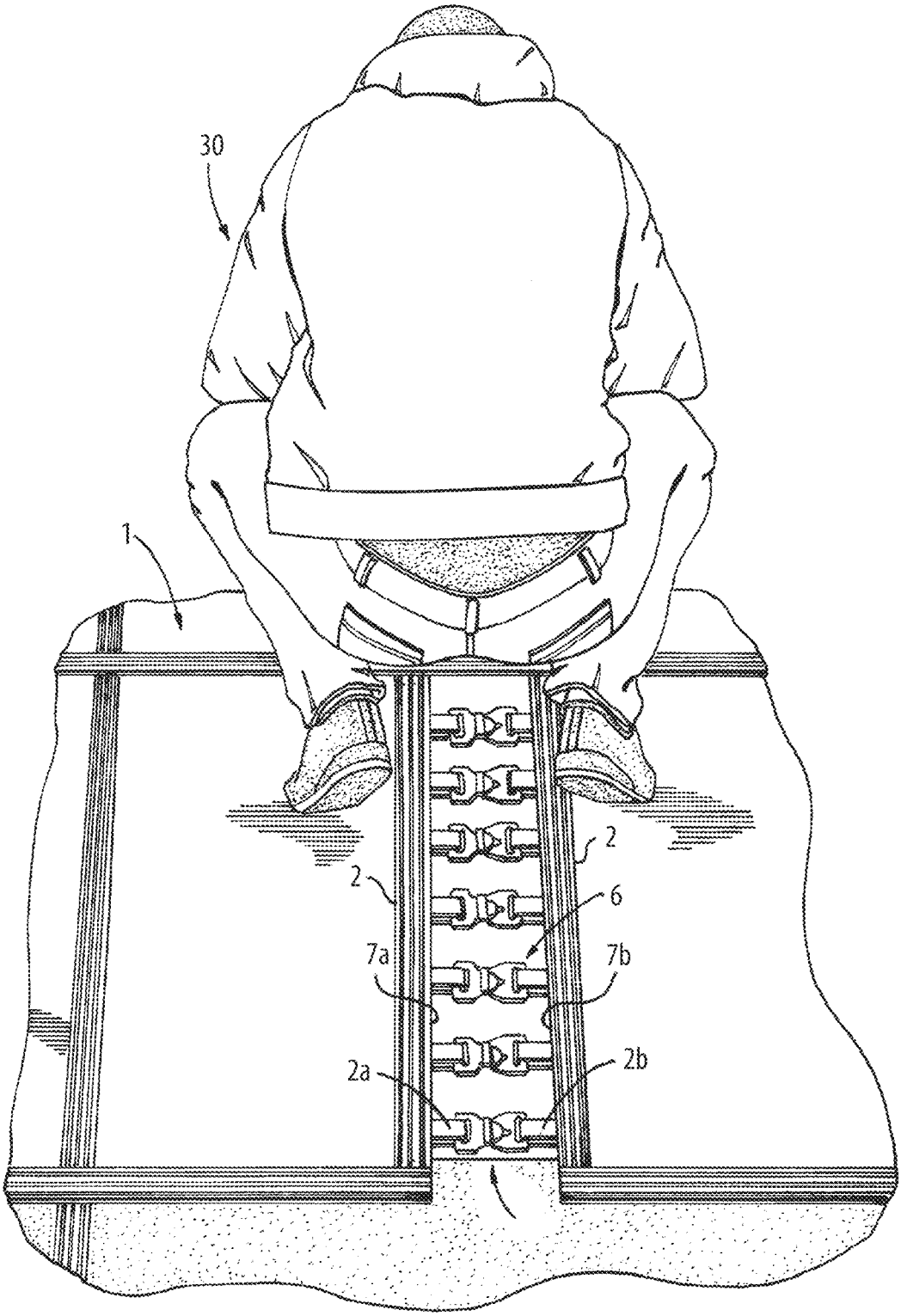
FIG. 7 is a perspective view showing a user installing the first and second pool cover straps in a tightening position with strap buckles extending over the open cutout gap, whereby the cut-out portion of the swimming safety pool cover is covered by the buckles and buckle straps with the straps having buckles to tighten the pool cover straps over the gap closure cover strip tightening the edges of the swimming pool cover adjacent to the edges of the cutout gap.

FIG. 7 is a perspective view showing a user 30 installing the first and second pool cover buckle straps 2*a* and 2*b* in a tightening position over the open gaps 6, 6*a*, 6*b*, or 6*c* (shown in FIG. 1) whereby the cut-out gap portion of the swimming safety pool cover 1 is covered by the multiple buckle straps 2*a*, 2*b* joined by buckles 20, shown in FIGS. 4, 5, and 6. The gaps 6, 6*a*, 6*b* or 6*c* of the swimming pool cover 1 extend lengthwise along two side edges 7*a* and 7*b* of the swimming pool cover 1, whereby the two edges 7*a* and 7*b* of the swimming pool cover 1 are connected by strap buckles 20 to extend over the open gap cutouts 6, 6*a*, 6*b* or 6*c*, which are cut out of swimming pool cover 1 to accommodate the upwardly extending obstacles, such as hand railing 5 or poles 3 (as in FIG. 1 and FIG. 8). The cutout edges 7*a* and 7*b* extend lengthwise along the edges of cutout gaps 6, 6*a*, 6*b* and 6*c* of swimming pool cover 1. Side edge portions 7*a* and 7*b* of swimming pool cover 1 in the vicinity of gap cutouts 6, 6*a*, 6*b* or 6*c*, are closed together by pool cover buckle straps 2*a* and 2*b* on each side portion, with the buckle straps 2*a* and 2*b* having buckles 20 to tighten the pool cover buckle straps 2*a* and 2*b* over the gap closure cutouts 6, 6*a*, 6*b* and 6*c* (shown in FIG. 1). The tightening of the edges 7*a* and 7*b* over the cutout gaps 6, 6*a*, 6*b* and 6*c*, helps prevents the remainder of the swimming pool cover 1 from being loosened over the swimming pool 10. Multiple pairs of buckle straps 2*a* and 2*b*, tightened by buckles 20, are closely spaced apart over cutout gaps 6, 6*a*, 6*b* and 6*c* so that the edges 7*a* and 7*b* of the swimming pool cover 1, are also tightened to prevent loosening of the remainder of the swimming pool cover 1.

Figure 8:
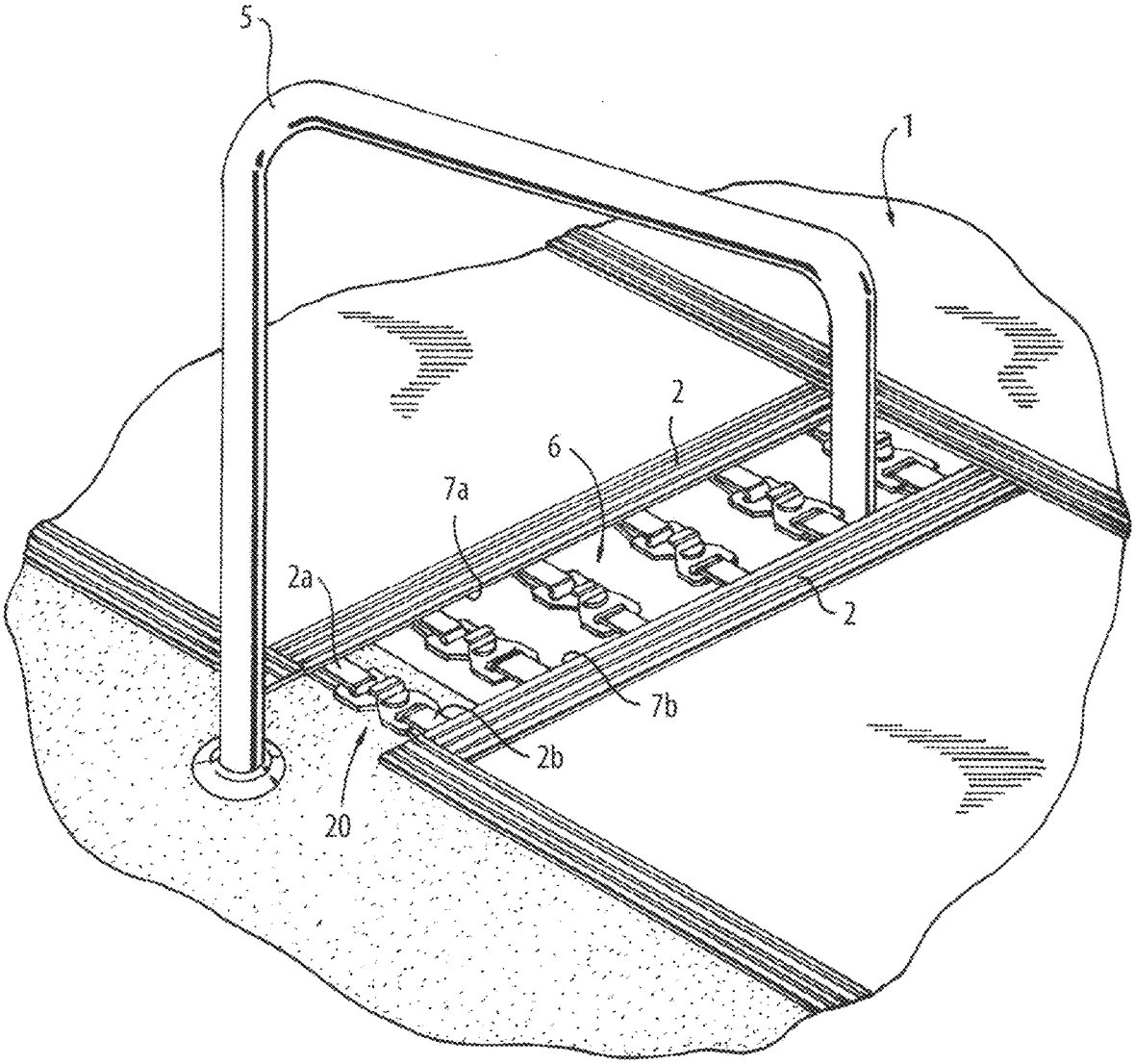
FIG. 8 is a close-up detailed view showing an L-shaped pool railing from above, wherein the safety pool cover has an open gap below the railing, whereby the open gap is covered by a plurality of buckles and buckle straps, which are connected in place prevent the edges of the swimming pool cover from loosening in the vicinity of the edges of the open cutout gap by the pool cover straps, each pair of straps having the buckle with the crescent-shaped half-moon protrusion member inserted edge-wise into the triangular receptacle of the buckle, and then rotated 90 degrees in a tightened position within the triangular receptacle of the buckle, to tighten the pair of pool cover straps, which extend over the open cutout gap accommodating an obstacle such as a hand railing above the taut surf ace of the swimming pool cover.

FIG. 8 is a close-up detailed view showing an L-shaped pool railing 5 from above, wherein the safety pool cover 1 has an open gap cutout 6 below the railing 5, as shown in FIG. 1, whereby the open gap 6 between adjacent edges 7*a* and 7*b* of pool cover 1 adjacent thereto (shown in FIGS. 4, 5, and 6), which are connected in place by buckle straps to cover the open railing gap 6 by the pool cover buckle straps 2*a* and 2*b*, each pair of buckle straps joined to the buckle 20, which is closed in place when a corner 20*f* of the crescent-shaped half-moon protrusion member/prong 20*a* is inserted edge-wise into the triangular receptacle 20*d* of the buckle 20, and then rotated 90 degrees in a tightened position within the triangular receptacle 20*d* of the buckle 20, to tighten the pair of pool cover buckle straps 2*a* and 2*b*, which keep the adjacent portions of pool cover 1 taut.

Strength Testing of Buckles

Applicant tested the new buckle 20, as compared to Prior Art buckle 3, to measure the strength of the buckle 20 by using a digital forklift scale and pulling the buckle and straps laterally, exerting pulling pressure against the Prior Art buckle 3, as compared to the new buckle 20. The Prior Art buckle 3 had a frame of three bars to loop the buckle straps around and back across each other. After 100 pounds of pressure, the bars of the Prior Art buckle 3 were bent and deformed, so that the flat surfaces of the three bars could no longer tightly grasp the buckle straps extended around and through the bars, causing failure of the Prior Art Buckle 3.

In contrast, the improved buckle 20 was subject to pulling pressure and measured on the forklift scale. After 400 pounds of pressure, the buckle 20 and the straps connected thereto were fully operational without any structural damage to the components of the buckle 20. The test was discontinued after the successful exertion of 400 pounds of lateral pressure and pulling force against the buckle 20 and buckle straps 2*a* and 2*b*.

Therefore, the buckle 20 is at least 4× as strong as the Prior Art buckle 3 in the rigorous strength testing performed by the Applicant herein.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. Apparatus for, and in combination with, a swimming pool cover, comprising:

a swimming pool cover configured to be installed and tensioned over said-a swimming pool;

said cover having slot cutouts to pass around obstructions and maintain total coverage denying access to water below in said swimming pool, the swimming pool cover coupled to a surface surrounding said swimming pool;

webbing straps extending from opposite side edges of said slot cutouts into said slot cutouts oppositely facing each other;

a two piece buckle for joining said webbing straps in each slot cutout, the two piece buckle comprising;

a male member in the form of a crescent half-moon shape, the male member coupled to one of said webbing straps in each slot cutout and a female member having a triangular shaped opening configured to receive said male member, the female member coupled to the oppositely facing webbing strap in each said slot cutout corresponding to a respective webbing strap including the male member;

the joining of said male member and said female member requiring rotation of said male member by about 90 degrees to enter said triangular shaped opening of said female member; and whereby tensioning of said swimming pool cover places a pulling force on joined male and female members making it impossible for the two pieces of said buckle to be rotated and disengaged.

2. The apparatus of claim 1 in which said obstructions include handrails or other fixed objects extending above a surface of said pool.

3. The apparatus of claim 1 in which said pointed end of said triangular shaped opening faces said male member.

4. The apparatus of claim 3 in which said crescent half-moon shape comprises a straight edge attached to a body of said male member and a hemispherical shaped edge opposite of said straight edge.

5. The apparatus of claim 4 in which disengagement of said buckle requires a 90-degree rotation of said male member.

* * * * *